US006435225B2

(12) United States Patent
Christy

(10) Patent No.: US 6,435,225 B2
(45) Date of Patent: Aug. 20, 2002

(54) GASSING OF CONTAINERS

(75) Inventor: Michael David Christy, Houghton (GB)

(73) Assignee: Harcoster Drums Limited, Cambridgeshire (GB)

( * ) Notice: Subject to any disclaimer, the term of this patent is extended or adjusted under 35 U.S.C. 154(b) by 0 days.

(21) Appl. No.: 09/771,330

(22) Filed: Jan. 26, 2001

(30) Foreign Application Priority Data

May 20, 2000 (GB) ..... 0012169

(51) Int. Cl.[7] ..... B65B 31/00
(52) U.S. Cl. ..... 141/48; 141/4; 141/35
(58) Field of Search ..... 141/1, 4, 35, 36, 141/48, 52

(56) References Cited

U.S. PATENT DOCUMENTS

| | | | | |
|---|---|---|---|---|
| 2,603,396 A | | 7/1952 | Redin et al. | 226/19 |
| 2,668,001 A | | 2/1954 | Harstick | 226/116 |
| 4,515,189 A | * | 5/1985 | Mowatt-Larssen | 141/11 |

FOREIGN PATENT DOCUMENTS

| | | |
|---|---|---|
| DE | 2003869 | 9/1971 |
| DE | 19945500 | 4/2000 |
| GB | 1170080 | 11/1969 |
| JP | 57047738 | 3/1982 |
| WO | WO0003633 | 1/2000 |

* cited by examiner

*Primary Examiner*—Gregory Huson
*Assistant Examiner*—Peter deVore
(74) *Attorney, Agent, or Firm*—Andrus, Sceales, Starke & Sawall, LLP

(57) ABSTRACT

A treatment method for the internal surface of a moulded polyethylene plastics material container such as a drum, comprising the steps of: introducing an ionisable gas, such as argon, into the container; generating a plasma of the introduced gas by applying electric field of sufficient strength to the container and introduced gas, so as to cause an interaction with the internal surface of the container; coating the internal surface of the container with a curable epoxy-based first polymeric composition; and then curing the polymeric composition to form a coating on the internal surfaces of the container. A second coating, preferably with electrical conductive properties, may be applied and cured over the first coating. Conductive properties may provided by including conductive particles such as antimony doped tin dioxide, graphite or metal powders, in the second composition.

19 Claims, 2 Drawing Sheets

CASCADE GASSING DIAGRAM

GASSING OF CONTAINERS

BACKGROUND OF THE INVENTION

A) Field of the Invention

This invention relates to a method of introducing a required gas into a succession of containers being advanced along a path. Further, the invention relates to apparatus for introducing a required gas into such a succession of containers.

B) Description of the Invention Prior Art

In order to permit the internal treatment of a moulded plastics container, a pre-cursor to the treatment step might be the filling of the container with a particular gas required for the treatment step. At its simplest, the gas may be injected into the container through a suitable opening and under a sufficient pressure to ensure that enough gas enters the container for the container to be essentially filled with the gas.

A simple gas-filling process as described above is relatively inefficient and leads to significant loss of the required gas, during the filling step. In an attempt to minimise the loss of the required gas, a closure arrangement may be provided around a gas supply pipe and which connects with the opening to the container. The disadvantage of this is that such a closure arrangement will also restrict the displacement of air within the container prior to the filling of the container with the required gas. Consequently, it is difficult to obtain a sufficiently high proportion of the required gas in the container during a simple filling step as described above, unless the filling step is continued for a significant period of time, so also leading to much higher losses of the required gas.

The loss of the required gas becomes more significant if that gas is toxic, or if it is relatively expensive. For example, if a container is to be filled with carbon dioxide, the loss of carbon dioxide to atmosphere may not be that important. On the other hand, if a container is to be filled with a gas such as a halogen (e.g. chlorine), significant measures must be taken to prevent the loss of the chlorine to atmosphere, especially in a factory environment, in view of the toxic nature of the gas. With a noble gas (e.g. argon), the loss of the gas to atmosphere may be significant economic complications for the treatment process and so should be avoided, as far as possible.

It has been proposed to minimise the loss of the required gas whilst at the same time optimising the filling of a container with the gas by partially evacuating air from the container before introducing the required gas into the container. In this way, intermixing of the required gas with air may be reduced, and during the filling step, the amount of gas displaced from the container can essentially be eliminated. However, in the case of a moulded plastics container the evacuation of the container rarely is a possibility, since the container is likely to collapse leading to damage to the walls of the container.

SUMMARY OF THE INVENTION

The present invention has been developed to overcome the disadvantages of the usual processes adopted for filling a container with a required gas, especially for a industrial process where a succession of containers are to be filled, as a pre-cursor to a treatment step for the interiors of the containers.

Accordingly, one aspect of this invention provides a method of introducing a required gas into each of a succession of containers being advanced along a path, comprising feeding the required gas into a first container, collecting the gas displaced from the first container as the required gas is fed thereinto, and feeding the displaced gas into a following container on the path.

According to a second, but closely related, aspect of this invention, there is provided apparatus for introducing a required gas into each of a succession of containers being advanced along a path, comprising a conveyor to effect advancement of the containers through a plurality of gas-feeding stations, first supply means to feed the required gas into a container located at a first gas-feeding station, first collection means for gas displaced from the first container at the first station, and second supply means to feed the gas collected by the first collection means into a container located at a second gas-feeding station.

It will be appreciated that with the method or apparatus of this invention, a succession of containers being advanced along a path are filled with the required gas by at least a two-stage process, but preferably by a multi-stage process (and typically a six-stage process) where the concentration of the required gas in the containers is increased as the containers move along the path. Thus, in a typical method, the gas displaced from each of five containers (by the step of feeding gas into the respective container) is collected and, in each case, is fed into the next following container on the path. Then, the gas displaced from the last container to which displaced gas is fed (that is, the sixth container in said typical method) is allowed to discharge to atmosphere.

The performance of the method should be optimised such that the gas displaced from the last container of the succession is substantially all air. The gas displaced from the other containers will be mixtures of air and the required gas, with the concentration of the required gas rising between each successive pair of containers from the last container. The leading container of the succession, and to which the required gas is supplied, will displace an air/required gas mixture having the highest concentration of the required gas. By adjusting the operating parameters of the method, it is in this way possible to achieve a very high concentration of the required gas in the leading container, with the minimal loss of the required gas from the last container in the succession.

BRIEF DESCRIPTION OF THE DRAWINGS

Various preferred aspects of the present invention and one specific embodiment thereof will now be described in detail, reference being made to the accompanying drawings, in which.

DESCRIPTION OF THE PREFERRED ARRANGEMENTS

To facilitate satisfactory operation of the method of this invention, it is preferred that the composition of the gases displaced from at least one of the containers be monitored. It is found that it is possible to monitor proper operation of the method, provided that the times and gas flow rates have properly been set, just by monitoring the composition of the gases displaced from the leading container.

Preferably, the containers are intermittently advanced along the path, with the gas feeding steps taking place whilst the containers are stationary. To this end, the apparatus may define a plurality (and typically six) gas feeding stations, with the containers stopping at each station to permit the feeding of gas thereto.

The feeding of the required gas into the leading container, and of the displaced gases into the following containers, is preferably performed such that there is turbulence within the respective container to ensure mixing of the gas already in the container and the gas being fed into the container. By mixing the gases in this way, the concentration of the required gas in the containers from the last container to the leading container will increase sequentially and also ensures repeatable and reliable operation of the method.

The method of this invention is applicable to the supply of a required gas to the interior of a moulded plastics material container. For example, the method may be used with a polyethylene blow-moulding in the form of an industrial drum having either one filling neck or a pair of spaced filling necks in an end wall of the drum, or in the form of a jerry-can having a top handle and an off-set filling neck in the top wall of the jerry-can.

A typical treatment process for a polyethylene container as mentioned above, following the introduction of the required gas into the container, is to subject each container to an externally- or internally-applied voltage gradient sufficient to create a plasma of the required gas within the container. This treatment process then renders the internal surface of the container susceptible for receiving an applied coating.

The required gas, or a displaced gas, as the case may be, preferably is supplied to a container by means of a pipe arranged to dip into a container for the time being located at a respective station on the apparatus, which pipe extends substantially to the bottom of the container. The collection means may include a pipe arranged to communicate with an upper region of the interior of a container. Then, by ensuring sufficient gas flow through the dip pipe, mixing of the introduced gas with gas already in the container will occur so that the displaced gas comprises a mixture of the already present gas and the introduced gas. To ensure minimum losses, seals should be provided around the or each opening to a container and a pipe extending through such openings.

Figure 1:
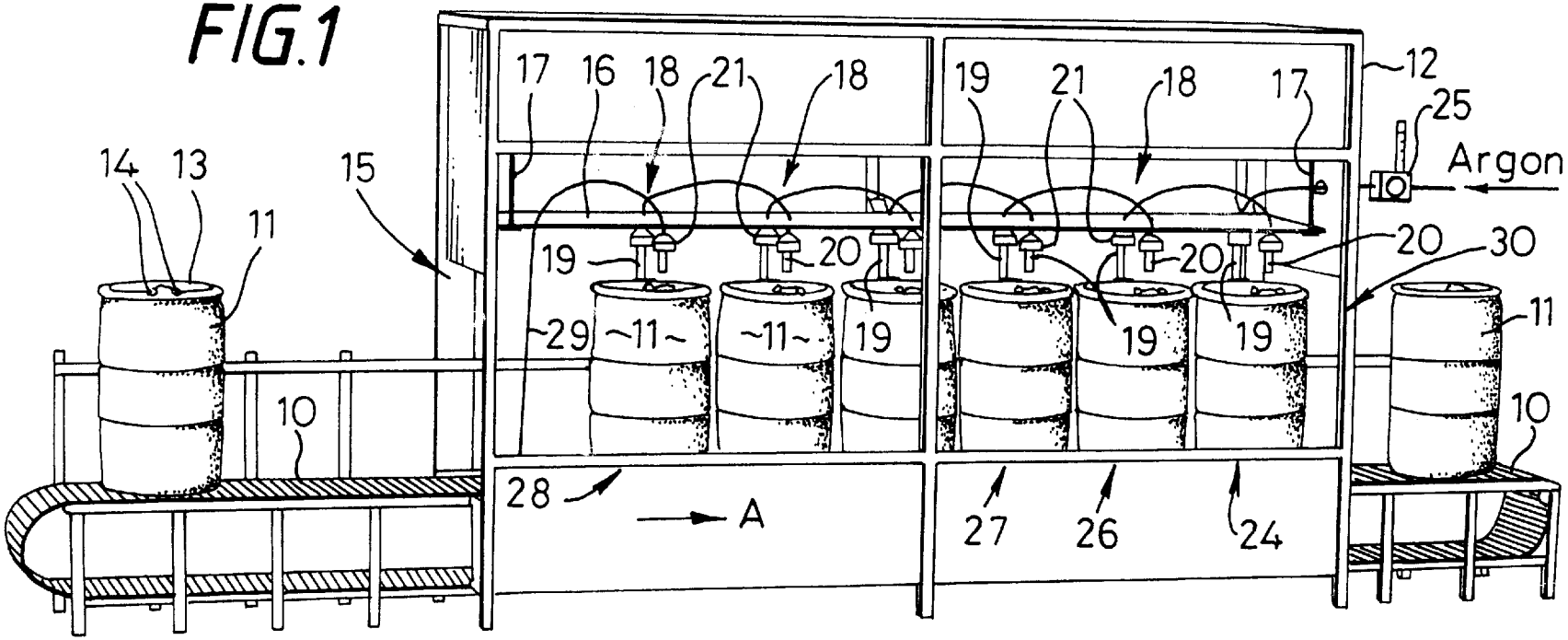
FIG. 1 is a general perspective view of a blow-moulded plastics container gassing plant arranged for filling the containers with a required gas prior to a subsequent treatment step.

The particular embodiment shown in the drawings will now be described. In FIG. 1, there is shown a conveyor 10 arranged to advance a plurality of blow-moulded plastics industrial drums 11 in the direction of arrow A through a cabinet 12 in which is installed apparatus to effect filling of the drums with argon gas. A intermittent drive arrangement (not shown) is provided for the conveyor, which operates in synchronism with the gas filling apparatus in the cabinet 12, as will be described below.

The cabinet 12 has a sufficient length along the conveyor 10 to accommodate six drums 11, disposed sequentially. Each drum has a top wall 13 provided with two filling necks 14 on a common diameter, which necks typically are threaded for receiving a closure when the drum is in use. Though not shown in FIG. 1, an indexing mechanism is provided at the inlet end 15 to the cabinet, to turn each drum entering the cabinet so as to have said common diameter right angles to the direction of advancement of the conveyor.

A beam 16 is suspended on rams 17 connected to an upper fixed part of the cabinet, so that actuation of the rams raises and lowers the beam 16. Six gassing heads 18 are mounted on the beam 16 with a suitable spacing therebetween such that each gassing head may connect with a drum 11 located therebelow for the time being, when the conveyor has been stopped. Each gassing head has two pipes 19 and 20, suitably positioned to pass respectively through the two filling necks 14 of the drum, on lowering of the beam 16. Associated with each filling pipe 19 and 20 of each head is a sealing assembly 21, adapted to fit over a filling neck 14 of the drum and to effect a seal thereto. For example, the sealing assembly 21 may be in the form of a bell housing having an internal resilient sealing member which engages the end face of a filling neck.

Figure 2:
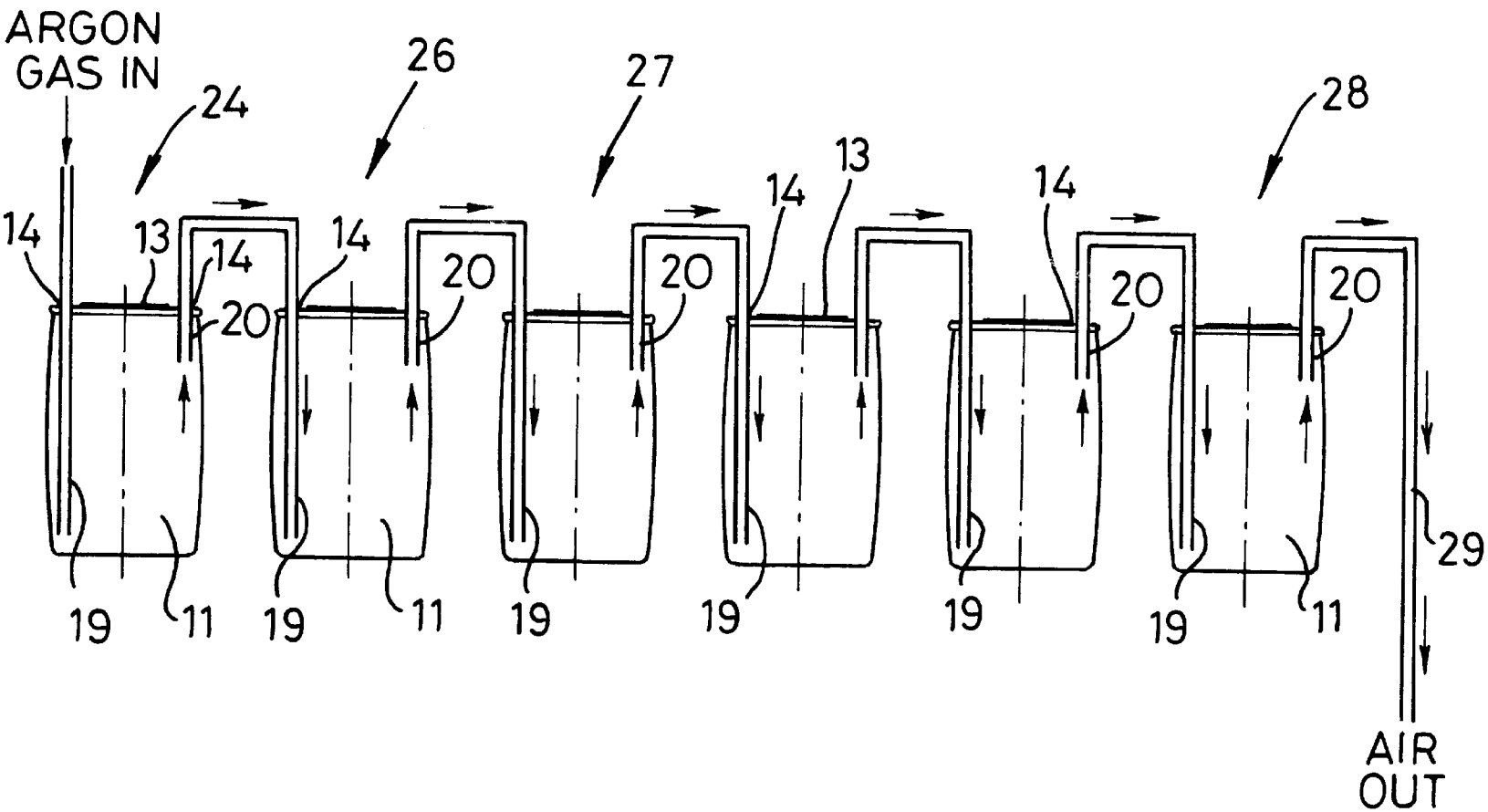
FIG. 2 diagrammatically illustrates the method of introducing a required gas (in this case, argon) into each of a succession of six containers being advanced by a conveyor.

As shown in FIG. 2, gas inlet pipe 19 of each gassing head is relatively long and reaches almost to the bottom of a drum 11 when the beam 16 is lowered to engage the sealing assembly 21 with the filling neck 14 of a drum. By contrast, gas outlet pipe 20 of each gassing head is relatively short and merely communicates with the upper internal region of a drum 11, when the beam 16 is lowered to engage the sealing assembly with the filling neck of a drum.

The gas inlet pipe 19 at the sixth stage 24 of the apparatus (i.e. that stage where the leading, or first, drum of an advancing succession of drums is treated) is connected by a flexible pipe to a control regulator 25, to which is connected a supply of argon gas. The gas outlet pipe 20 at the sixth stage 24 of the apparatus is connected to the gas inlet pipe 19 at the fifth stage 26 of the apparatus, and the gas outlet pipe 20 at the fifth stage 26 is connected to the gas inlet pipe 19 at the fourth stage 27, and so on to the first stage 28. At the first stage 28, the gas outlet pipe 20 is connected to an exhaust pipe 29, leading to a suitable vent pipe (not shown) discharging to atmosphere.

Following the filling of the drums 11 with argon, which will be described in greater detail below, the drums are discharged from the outlet end 30 of the cabinet 12, and are taken to such further treatment apparatus as may be required. For example, the conveyor 10 may carry the drums to an electro-discharge treatment machine (not shown) where each drum is subjected to a relatively high electrical field sufficient to cause ionisation of the argon within the drum. Prior to this, at the outlet end of the cabinet 12, sealing caps may be fitted to the filling necks, so as to retain the argon within the drums.

The operating parameters of the apparatus described above need to be set so that the drums are sufficiently filled with argon for the performance of the subsequent treatment, in a sufficiently short time to ensure the overall process may be operated rapidly and efficiently, with a minimal wastage of argon. To achieve this, the cycle time needs to be set in association with the argon flow rate, with the object of achieving in the drums an argon/air mixture with approximately 60% argon. The satisfactory operation of the method may be monitored by observing the argon/air mix displaced from the sixth stage 24 and which is supplied to the fifth stage 26. Moreover, it may be desirable to monitor the gas displaced from the first stage 28, to ensure that the flow rates are such that no significant quantity of argon is discharged to atmosphere from the first stage.

It will be appreciated that as the filling progresses, argon introduced at the sixth stage displaces the gas in the drum for the time being at the sixth stage, which gas was itself a mixture of argon and air introduced at the fifth stage on he previous cycle of operation. This displacement of gas from one drum to the ext adjacent drum is carried through all six drums in the cabinet on each cycle, ith the drums being advanced from one stage to the next at the start of each cycle. In this way, the concentration of argon in each drum is increased as the drum is advanced from the first stage to the sixth stage.

Trials on industrial drums of approximately 220 litre capacity have shown that using a six stage apparatus, a cycle time of 60 seconds and an argon flow rate of approximately 170 litres/minute, steady-state operation (i.e. after six drums have moved through the cabinet at the start of operation) gives rise to the following argon/air mixtures in each of the six drums in the six stages of the apparatus.

| | Stage 1 | Stage 2 | Stage 3 | Stage 4 | Stage 5 | Stage 6 |
|---|---|---|---|---|---|---|
| Argon content of displaced gas | 0 | 3% | 10% | 19% | 33% | 57% |

From the above table, it will be appreciated that effectively only air is displaced from the drum at the first stage 28 of the apparatus and that essentially the required argon concentration is achieved in the drum at the sixth stage 24, to which pure argon is supplied.

I claim:

1. A method of introducing a required gas into each of a succession of molded plastics material containers being advanced along a path, comprising the steps of feeding the required gas into a first molded plastics material container, collecting the gas displaced from the first container as the required gas is fed thereinto, and feeding the collected displaced gas into a molded plastics material container following said first molded plastics material container along the path.

2. A method as claimed in claim 1, comprising the steps of collecting the displaced gas from a container and feeding that displaced gas into a following container on the path simultaneously and sequentially on a succession of containers on the path.

3. A method as claimed in claim 2, wherein the gas displaced from the last container to which displaced gas is fed is exhausted to atmosphere.

4. A method as claimed in claim 2, wherein the gas displaced from each of five containers is collected and, in each case, is fed into the next following container on the path.

5. A method as claimed in claim 2, wherein the containers are intermittently advanced along the path, the gas feeding steps taking place whilst the containers are stationary.

6. A method as claimed in claim 5, comprising the step of subjecting each container, in turn, to each gas feeding step ending with the gas feeding step utilising the required gas.

7. A method as claimed in claim 1, comprising the additional step of monitoring the gases displaced from at least one of the containers during the associated gas feeding step.

8. A method as claimed in claim 7, comprising monitoring the composition of the gases displaced from the container to which the required gas is fed, and controlling the feeding of the required gas dependent thereupon.

9. A method as claimed in claim 1, wherein feeding of the gas into a container is carried out at a rate sufficient to cause turbulence within the container such that there will be intermixing between gas already in the container and the gas fed thereinto.

10. A method as claimed in claim 1, wherein each container comprises a polyethylene blow-moulding.

11. A method as claimed in claim 10, wherein each container is in the form of an industrial drum having at least one filling neck in an end wall of the drum, or is in the form of a jerry-can having a top handle and an off-set filling neck in the top wall.

12. A treatment process for a succession of moulded plastics material containers being advanced along a path, which process comprises introducing a required gas into each of the containers by a method of claim 1, and then subjecting each container containing the required gas to an applied voltage gradient sufficient to create a plasma of the required gas within the container.

13. Apparatus for introducing a required gas into each of a succession of containers, the containers being advanced along a path, comprising a conveyor to effect advancement of the containers through a plurality of gas-feeding stations, a first gas-feeding station at which first supply means feed the required gas into a container located thereat, first collection means for gas displaced from the first container at the first station, and a second gas-feeding station at which second supply means feed the gas collected by the first collection means into a container located thereat.

14. Apparatus as claimed in claim 13, wherein there are more than three gas-feeding stations, each said station, except for the last station in the succession thereof, having a respective gas collection means connected to the supply means of the next adjacent station.

15. Apparatus as claimed in claim 14, wherein there are six gas-feeding stations arranged along the conveyor, for the sequential treatment of containers advanced therethrough.

16. Apparatus as claimed in claim 13, wherein each supply means includes a pipe arranged to dip into a container for the time being located at the respective station, substantially to the bottom of the container.

17. Apparatus as claimed in claim 13, wherein each collection means includes a pipe arranged to communicate with an upper region of the interior of a container for the time being located at the respective station.

18. Apparatus as claimed in claim 17 and for use with a container having an upper wall and an opening therein, wherein the collection and supply pipes are arranged to enter the container through said opening and there is provided means to effect a seal between the pipes and the upper wall defining the opening.

19. Apparatus as claimed in claim 17 and for use with a container having an upper wall and two openings therein, wherein the collection and supply pipes are arranged to enter the container one through each opening respectively and there is provided respective sealing means to effect a seal between each pipe and the container wall defining the respective opening.

* * * * *

UNITED STATES PATENT AND TRADEMARK OFFICE

CERTIFICATE OF CORRECTION

PATENT NO. : 6,435,225 B2
DATED : August 20, 2002
INVENTOR(S) : Michael David Christy It is certified that error appears in the above-identified patent and that said Letters Patent is hereby corrected as shown below:

Title page,
Item [73], Assignee: replace "Harcoster" with -- Harcostar --

Signed and Sealed this

Twenty-eighth Day of January, 2003

JAMES E. ROGAN
*Director of the United States Patent and Trademark Office*